United States Patent [19]

Scheindel

[11] 4,227,482

[45] Oct. 14, 1980

[54] PRESSURIZED FLUID-ACTUATED SOUND-PRODUCING DEVICE, AND METHOD OF ASSEMBLING IT

[76] Inventor: Christian T. Scheindel, Star Route, Randolph Center, Vt. 05061

[21] Appl. No.: 57,539

[22] Filed: Jul. 13, 1979

[51] Int. Cl.[3] ..... G08B 23/00

[52] U.S. Cl. ..... 116/142 FP; 29/169.5; 116/112; 116/DIG. 44; 222/39

[58] Field of Search ..... 116/142 FP, DIG. 44, 116/22 R, 24; 222/39

[56] References Cited

U.S. PATENT DOCUMENTS

| | | | |
|---|---|---|---|
| 2,977,973 | 4/1961 | Chakine | 116/DIG. 44 |
| 3,325,054 | 6/1967 | Braun | 222/39 |
| 3,590,770 | 10/1969 | Wagner | 116/112 |
| 3,785,335 | 1/1974 | Wagner | 116/142 X |
| 4,166,428 | 9/1979 | Freeman et al. | 222/39 X |

*Primary Examiner*—Daniel M. Yasich
*Attorney, Agent, or Firm*—Alan H. Levine

[57] ABSTRACT

A sound-producing device, for use with a pressurized fluid container, includes a body having an orifice surrounded by an annular seat, a cap facing the seat, and a diaphragm held taut over the seat, the margin of the diaphragm being tightly gripped between the body and cap. The body and cap are locked together within a housing, the housing also serving to mount the sound-producing device on a pressurized fluid container. The body and cap present annular beads of different diameters for deforming and tightly holding the margin of the diaphragm. A flexible strip permanently connects the body and cap. The parts are assembled by aligning, in side-by-side relation, a plurality of members, each comprising a body, a cap, and a connecting strap, and applying a length of adhesive-bearing flexible tape to the plurality of members, the tape adhering to one of the body and cap, preferably the cap, of each member. The line is advanced in stepwise fashion, and the tape severed sequentially between successive members near the downstream end of the line. The strap of the endmost member in the line is folded to bring its body and cap into face-to-face relation with the cut piece of tape, serving as the diaphragm, between them. The folded member is inserted into a housing wherein its body and cap are locked together so as to hold the tape or diaphragm taut over the seat.

11 Claims, 9 Drawing Figures

PRESSURIZED FLUID-ACTUATED SOUND-PRODUCING DEVICE, AND METHOD OF ASSEMBLING IT

This invention relates to sound-producing devices of the type actuated by pressurized fluid and more particularly to such a device wherein a flowing gas vibrates a diaphragm to produce the sound.

A conventional sound-producing device of this type, illustrated and described in U.S. Pat. No. 3,670,689, includes a body having an orifice at one end of a horn, the orifice being surrounded by an annular seat. A chamber, in the body, radially outwardly of the end of the horn having the seat, communicates with the valve of a pressurized fluid container. A diaphragm of thin metal or plastic engages the seat and extends radially beyond the seat to form one wall of the chamber. The margin of the diaphragm is sandwiched between an end edge of the body and a cap mounted on the body by means of a snap closure. When the container valve is opened, compressed gas flows into the chamber and periodically forces the diaphragm away from the seat to allow the gas to leave the chamber by flowing around the seat, through the length of the horn, and into the atmosphere. The flow of gas causes the diaphragm to vibrate and produce sound. When the container valve is closed, the sound ceases.

While the device described above appears to operate satisfactorily when a relatively stiff diaphragm is employed, a problem is presented should a thinner diaphragm material be used, such as plastic sheet material having the thickness of pressure sensitive adhesive tape sold for office, school, and home use. The purpose of using such material is to reduce the cost of the device. Since this tape material has little stiffness, its margin is readily pulled from between the body and cap when the chamber is pressurized, because the snap closure between the body and cap does not cause the margin to be gripped with sufficient force. The utility of the device is thereby destroyed, since the diaphragm must be held taut against the seat for sound to be produced. The same problem is presented if a metal foil is used as the diaphragm.

An attempt to overcome this problem involves the use of a cap which joins the body by means of a screw thread. While this permits the diaphragm margin to be gripped tightly between the body and cap, use of a screw thread adds substantially to the cost of manufacture and assembly of the device.

It is an object of the present invention to overcome these problems by providing a sound-producing device of the type described employing a very inexpensive diaphragm material, and which nevertheless can be assembled economically on a mass production basis.

It is another object of the invention to provide a sound-producing device wherein the body and cap, between which the diaphragm is sandwiched, are formed as an integral unit.

It is a further object of the invention to provide such a device wherein the body and cap are locked together, gripping the diaphragm between them, by sliding them together into a housing within which they are then permanently accommodated.

It is an additional object of the invention to provide such a device wherein a flexible strap integrally joining the body and cap serves as a means for folding the cap and body into face-to-face relationship preparatory to inserting them into a housing wherein the cap and body are locked together with the diaphragm between them.

It is another object of the invention to provide an assembly method whereby a plurality of members, each including a body, a cap, and a connecting strap, are aligned, a length of tape applied to the members, and the tape severed sequentially to free individual members, the endmost member then being folded so that the cut piece of tape serves as the diaphragm.

Additional objects and features of the invention will be apparent from the following description, in which reference is made to the accompanying drawings.

The sound-producing device and pressurized fluid container chosen to illustrate the present invention is of a size which is easily held in the hand and fits, for example, into a woman's purse. The high pitched whistle which it emits may be used as a defense against attackers, as well as a signal to summon help.

Figure 1:
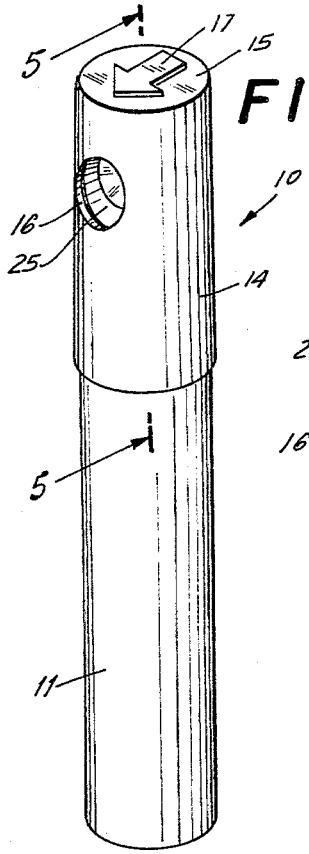
FIG. 1 is a perspective view of a sound-producing device according to the present invention.
Figure 5:
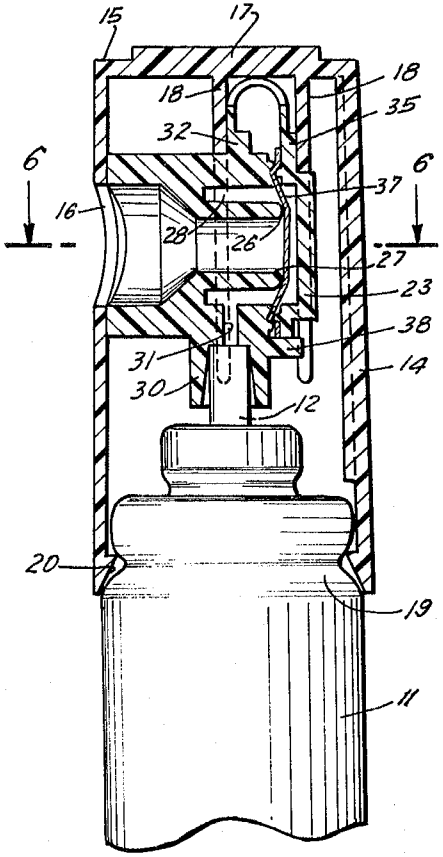
FIG. 5 is a vertical cross-sectional view taken along line 5—5 of FIG. 1.

The sound-producing device 10 is shown in FIG. 1 mounted on a conventional container 11 filled with a compressed or liquified gas, such as Freon, a fluorocarbon propellant, or any other suitable liquid which vaporizes at room temperature and pressure. Mounted at the top of container 11 is a conventional valve including a hollow stem 12 (FIG. 5) which when depressed, i.e., pushed longitudinally toward the interior of container 11, opens the valve to permit pressurized gas to flow from the container through stem 12.

Figure 8:
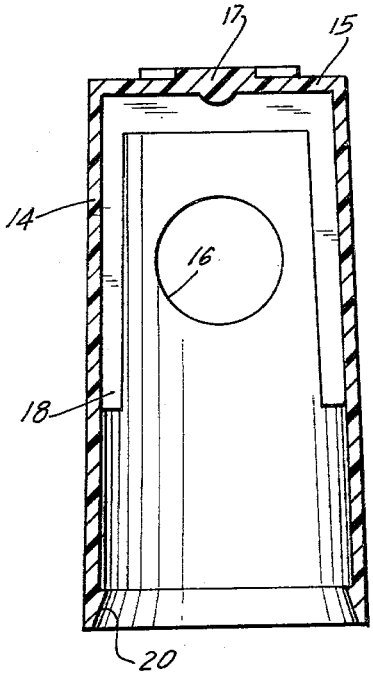
FIG. 8 is a longitudinal cross-sectional view through the housing.
Figure 7:
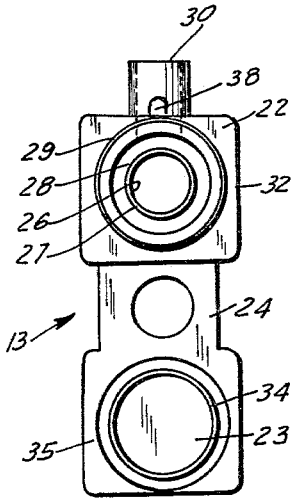
FIG. 7 is a face view of the body and cap member.
Figure 2:
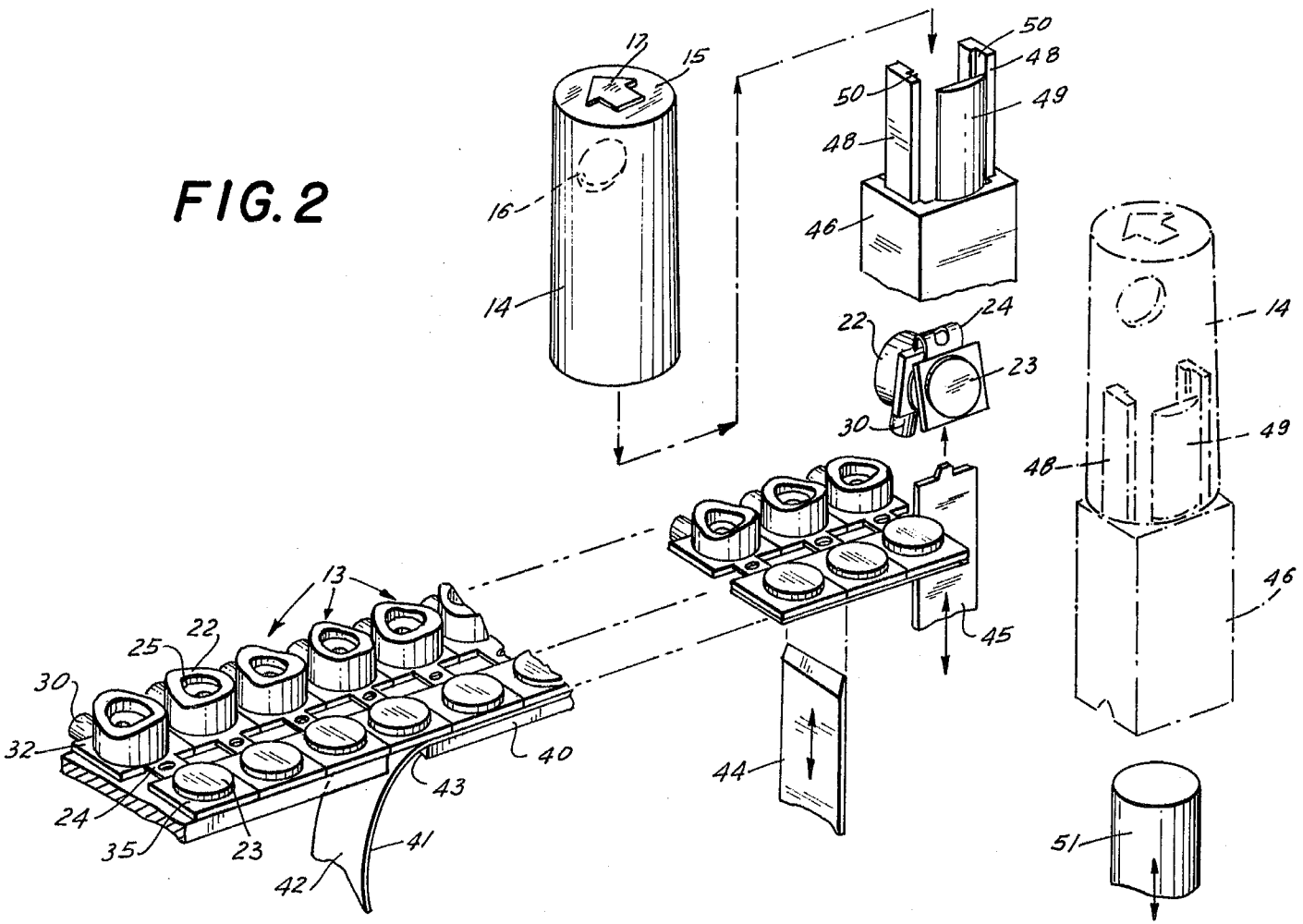
FIG. 2 is a fragmentary perspective view illustrating the method of assembling the sound-producing device.
Figure 4:
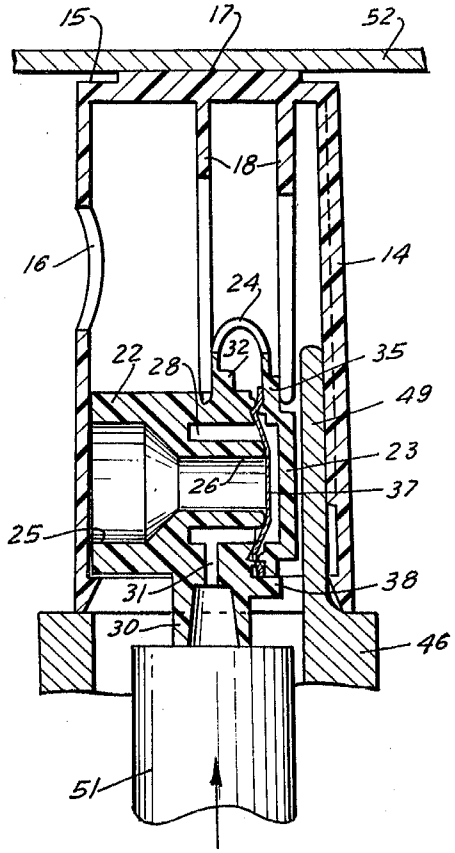
FIG. 4 is a vertical cross-sectional view showing the folded body and cap member being inserted into the housing.

Sound-producing device 10 includes a member 13, best seen in FIGS. 2 and 7, located within a housing 14 (FIGS. 1 and 8). The housing, which may be a one-piece molded plastic element, includes a generally cylindrical side wall closed at one end by a top wall 15 and open at its bottom. As may be seen in FIG. 8, the side wall tapers very slightly outwardly from top to bottom. A hole 16 is formed in the side wall of housing 14, and an arrow 17 is molded into top wall 15, the arrow pointing in the direction in which hole 16 opens. Within housing 14 are two inwardly projecting, inverted U-shaped, ribs 18 (FIGS. 4 and 8). The ribs are parallel to each other and spaced apart. As will be described below, the ribs serve as locking means for member 13. At its open end, housing 14 has an inwardly directed annular lip 20 which snaps into an annular groove 19 (FIG. 5) near the top of container 11 to thereby mount the sound-producing device on the container.

Figure 6:
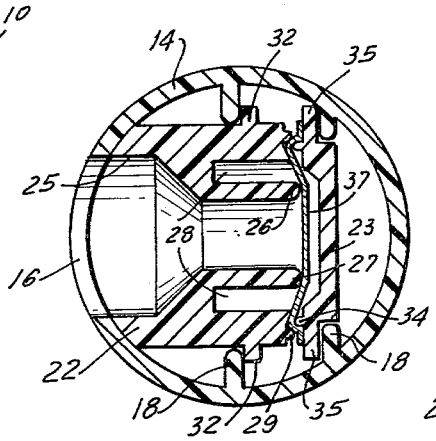
FIG. 6 is a horizontal cross-sectional view taken along line 6—6 of FIG. 5.

Member 13 includes a body 22, a cap 23, and a flexible strap 24 permanently joining the body and cap. Preferably, all three parts of member 13 are formed of one piece of molded plastic. Body 22 is formed with a fluid passageway 25 (FIGS. 5 and 6) having a relatively small diameter orifice 26 at its inner end, a larger diameter portion at its outer end, and a tapered transition portion between them. An annular seat 27 (FIGS. 3 and 7) surrounds orifice 26, and an annular chamber 28 is located radially outwardly of seat 27. Surrounding chamber 28 is an annular bead 29. A tubular nipple 30 projects from body 22, and communicates with chamber 28 through a passage 31. Nipple 30 fits snugly over valve stem 12 (FIG. 5) of container 11. A rectangular flange 32 projects laterally from body 22.

Cap 23 is formed with an annular bead 34 (FIGS. 3, 6, and 7) of slightly smaller diameter than the bead 29 of body 22. The cap also has a rectangular, outwardly projecting, rectangular flange 35 about equal in size to flange 32 of body 22.

When member 13 is located in its permanent position within the upper portion of housing 14 (FIGS. 5 and 6), member 13 has been folded from its original flat condition (FIGS. 2 and 7) into a condition in which body 22 and cap 23 are in face-to-face contact. This 180° fold is permitted by the flexibility of strap 24. A post 38 on body 22 serves as a guide to proper positioning of the cap and body with respect to each other. Flange 32 of body 22 and flange 35 of cap 23 are located between the spaced apart ribs 18 within housing 14. The spacing between the ribs is such that the body and cap are tightly squeezed together, or more correctly bead 29 is pressed against cap 23 and bead 34 is pressed against body 22.

Figure 9:
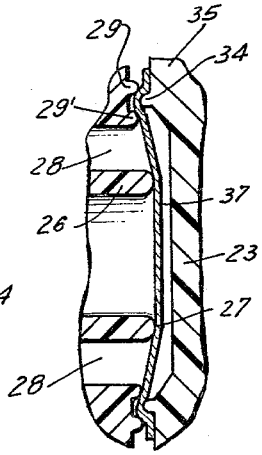
FIG. 9 is a fragmentary cross-sectional view showing an alternative formation for gripping the margin of the diaphragm.

A diaphragm 37 extends over seat 27 and chamber 28 to define one wall of the chamber. The margin of the diaphragm is tightly gripped between the beads 29 and 34, the presence of the beads deforming the diaphragm margin to insure that the margin cannot slip out from between body 22 and cap 23. Under certain conditions, it may be desirable to employ a second bead, e.g., bead 29' (FIG. 9) on one of the body or cap to grip the margin of the diaphragm even tighter. The diaphragm is held taut and in engagement with seat 27. Diaphragm 37 is preferably an inexpensive sheet material, such as a piece of ordinary plastic tape having pressure sensitive adhesive on one face, although other suitable materials such as metal foil could be used.

Due to the downwardly and outwardly tapered shape of lip 20 (FIG. 5), at the open lower end of housing 14, and the inherent resilience of the cap material, the lip can slide over the upper end portion of container 11 into groove 19. However, housing 14 cannot then be readily removed from container 11. In this condition, the upper end of valve stem 12 engages the top interior wall of nipple 30. There is freedom for some further downward movement of housing 14 with respect to container 11. Consequently, when the top wall 15 is pushed downwardly a small amount, housing 14 moves downwardly depressing valve stem 12 and opening the valve. Gas under pressure rushes out of stem 12, through passage 31 and into chamber 28. The buildup of pressure in the chamber causes diaphragm 37 to flex away from seat 27, allowing the pressurized fluid to flow around seat 27, and through orifice 26, passageway 25, and hole 16, to the atmosphere. This flow of fluid momentarily relieves the pressure in chamber 28 so that diaphragm 37 tends to return to seat 27, causing another pressure increase in chamber 28. The result is a high frequency vibration of diaphragm 37 producing a high pitched whistle. When pressure on top wall 15 is released, the usual spring (not shown) within the valve returns stem 12 upwardly and closes the valve. The arrow 17 indicates the direction in which the sound emanates from the device.

The sound-producing device of this invention is particularly easy to assemble on a mass production basis. As indicated in FIG. 2, a plurality of members 13, in flat condition, are aligned in contiguous side-by-side relation on a support surface 40. A length of tape 41, having a pressure-sensitive adhesive on its upper surface 42, extends from a supply roll (not shown) beneath support surface 40, through a slot 43 in the support surface, on to the portion of the surface beneath the caps 23 of members 13. The tape 41 has a width about equal to that of flange 35. The caps thus stick to the tape thereby keeping all the members 13 in proper alignment. The tape could be located beneath bodies 22, instead of beneath caps 23. However, since the tape, which will serve as the diaphragm in each device must move away from seat 27 when in use, it is preferable that the non-adhesive surface of tape 41 face body 22.

Figure 3:
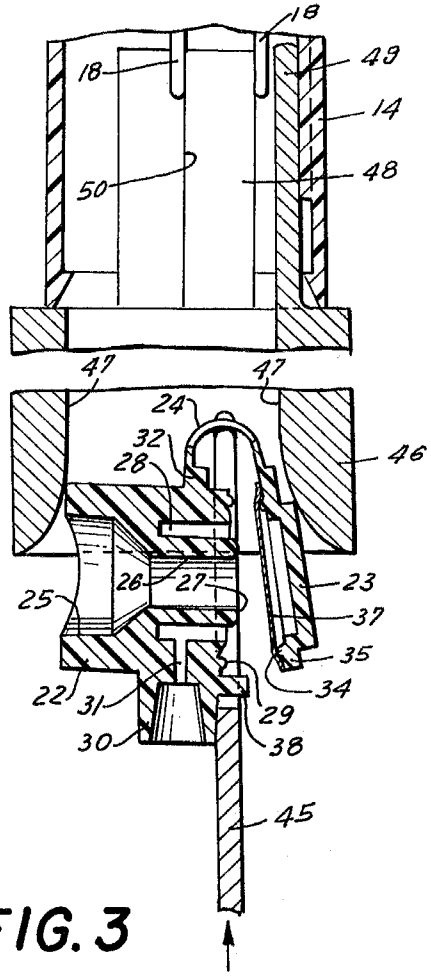
FIG. 3 is a vertical cross-sectional view showing the body and cap member being inserted into a folding jig.

A vertically reciprocable knife 44 is located beneath the support surface 40, near the rightward end of the latter (as viewed in FIG. 2), and is movable upwardly through a slot (not shown) in the support surface to sever tape 41 between two successive members 13. Knife 44 may be operated by any suitable device, such as a pneumatic piston-cylinder device. At its rightward end, support surface 40 is formed with a short longitudinal slot (not shown) through which a pusher blade 45 is vertically reciprocable. This blade may also be operated by a pneumatic piston-cylinder device. Directly above pusher blade 45 is a folding jig 46 which, as shown in FIG. 3, includes two parallel walls 47, the lower ends of which are tapered outwardly and downwardly as a "lead-in". On top of jig 46 are three upstanding fingers 48 and 49 over which an empty housing 14 may be placed, open end down. Two of the fingers 48 have an interior stepped configuration 50 for accommodating the internal ribs 18 of housing 14, thereby insuring that the housing can be placed over fingers 48 and 49 in only one angular orientation, i.e., the proper orientation fo receiving flanges 32 and 35 between ribs 18.

Folding jig 46 is horizontally reciprocable in a direction perpendicular to the longitudinal direction of the line of members 13, between the positions shown in full and dot-dash lines in FIG. 2. Any suitable device, such as a pneumatic piston-cylinder device may be used for this purpose. Beneath the dot-dash location of jig 46 is a vertically reciprocable plunger 51, operable by suitable means such as a pneumatic piston-cylinder device.

The line of members 13 is advanced, in stepwise fashion, longitudinally along support surface 40. Each advancement moves the line a distance equal to the width of one member 13. The advancement may be performed by hand, or by a suitable device such as a pneumatic piston-cylinder means. Between each two successive advancements of members 13, knife 44 operates to sever tape 41 between two successive members 13. At the same time, pusher blade 45 rises to engage strap 24 of the endmost member 13 in the line and insert that member into the lower end of folding jig 46, as shown in FIG. 3. The cut piece of tape (or diaphragm) 37 adheres to cap 23 so that it ultimately becomes sandwiched between the cap and body 22. At this time, an empty housing 14 is placed over fingers 48 and 49. Pusher 45 returns to its lower position, leaving the folded member 13 in jig 46, and the jig then moves to the dot-dash position in FIG. 2, the housing moving beneath a hold-down plate 52 (FIG. 4). Plunger 51 then rises through jig 46 engaging nipple 30 and pushing the folded member 13 into housing 14. At the completion of the upward stroke of plunger 51, member 13 is completely assembled with housing 14, i.e., the condition shown in FIG. 5. The assembled housing 14 and member 13 are then ready for assembly with container 11.

Advantageously, two folding jigs are employed, so that when jig 46 moves to the dot-dash position, the second folding jig moves into position directly above pusher blade 45, and the line of members 13 is advanced again. In this way, while plunger 51 is pushing one folded member 13 into a housing 14, pusher blade 45 inserts the next member 13 in the line into the second jig. When the first folding jig is moved back above pusher blade 45, the second jig moves over another plunger (not shown) similar to plunger 51 for pushing the folded member 13 in the second jig into a housing 14.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

I claim:

1. A sound-producing device for use with a pressurized fluid container having a valve, comprising:

(a) a body coacting with the container valve and having an orifice surrounded by an annular seat, and a chamber radially outwardly of said seat adapted to receive pressurized fluid from the container when the valve is open, (b) a cap facing said seat and chamber, (c) a strap permanently interconnecting said body and cap, (d) a diaphragm extending over said seat and chamber, the margin of said diaphragm being sandwiched between said body and cap, (e) means for locking said body and cap in tight engagement so that they tightly grip said diaphragm between them and hold said diaphragm taut over said seat, and (f) means carried by at least one of said body and cap for deforming the margin of said diaphragm to aid in tightly gripping said diaphragm between said body and cap, whereby pressurized fluid which enters the chamber escapes therefrom by flowing between the tautly-held diaphragm and said seat and then out the orifice, thereby causing the diaphragm to vibrate and create a sound.

2. A sound-producing device as defined in claim 1 including a housing carrying said locking means, said housing including means for mounting the sound-producing device on a pressurized fluid container.

3. A sound-producing device as defined in claim 1 including a housing accommodating said body and cap, said locking means comprising a pair of spaced apart ribs within said housing, and each of said body and cap having a flange located between said ribs.

4. A sound-producing device as defined in claim 1 including a generally cylindrical housing having a closed end and an open end, said body and cap being accommodated within said housing near its closed end, and means at the open end of said housing for mounting said housing on a pressurized fluid container.

5. A sound-producing device as defined in claim 4 including a hole in the cylindrical wall of said housing aligned with the orifice of said body.

6. A sound-producing device as defined in claim 1 including a tubular nipple projecting from said body for snugly accommodating a stem of the pressurized container valve, the interior of said nipple communicating with said chamber.

7. A sound-producing device as defined in claim 1 wherein said strap is flexible.

8. A sound-producing device as defined in claim 1 wherein said body, cap, and strap are formed of one piece of molded plastic.

9. A sound-producing device as defined in claim 1 wherein said diaphragm is a piece of plastic tape having pressure sensitive adhesive on one face.

10. A sound-producing device as defined in claim 1 wherein said body and cap have opposed beads of different diameters for deforming the margin of said diaphragm to aid in tightly gripping said diaphragm.

11. A sound-producing device for use with a pressurized fluid container having a valve, comprising:

(a) a body coacting with the container valve and having an orifice surrounded by an annular seat, and a chamber radially outwardly of said seat adapted to receive pressurized fluid from the container when the valve is open, (b) a cap facing said seat and chamber, (c) a strap permanently interconnecting said body and cap, (d) a diaphragm extending over said seat and chamber, the margin of said diaphragm being sandwiched between said body and cap, and (e) means for locking said body and cap in tight engagement so that they tightly grip said diaphragm between them and hold said diaphragm taut over said seat, said means including a pair of surfaces spaced apart a fixed distance, and said body cap being located between said surfaces, whereby pressurized fluid which enters the chamber escapes therefrom by flowing between the tautly-held diaphragm and said seat and then out the orifice, thereby causing the diaphragm to vibrate and create a sound.

* * * * *